United States Patent [19]

Hecht et al.

[11] Patent Number: 4,569,290

[45] Date of Patent: Feb. 11, 1986

[54] CARRIAGE

[75] Inventors: Joachim Hecht, Mettmann; Wilfried Loedige, Iserlohn; Friedrich Rohde, Wetter; Gerhard Rudat, Hagen; Fred Wiggershaus, Gevelsberg; Klaus-Juergen Winter, Wetter, all of Fed. Rep. of Germany

[73] Assignee: Mannesmann AG, Duesseldorf, Fed. Rep. of Germany

[21] Appl. No.: 573,560

[22] Filed: Jan. 25, 1984

[30] Foreign Application Priority Data

Jan. 26, 1983 [DE] Fed. Rep. of Germany ..... 3302485

[51] Int. Cl.[4] ..... B61B 3/00

[52] U.S. Cl. ..... 105/154; 411/75; 411/354; 403/324

[58] Field of Search ..... 105/148, 154; 104/89, 104/95; 411/75, 79, 354, 355; 403/324, 378, 379

[56] References Cited

U.S. PATENT DOCUMENTS

| | | | |
|---|---|---|---|
| 1,050,385 | 1/1913 | Palmgren | 411/354 |
| 1,496,630 | 6/1924 | Hendrickson | 411/354 |
| 1,652,009 | 12/1927 | Hoffmaster | 105/154 |
| 2,744,472 | 5/1956 | Symons | 105/154 |
| 3,261,477 | 7/1966 | Powell | 105/154 |
| 4,339,212 | 7/1982 | Sauber | 403/379 |

FOREIGN PATENT DOCUMENTS

| | | | |
|---|---|---|---|
| 2065583 | 7/1981 | United Kingdom | 105/154 |
| 2072596 | 10/1981 | United Kingdom | 105/154 |

*Primary Examiner*—Louis J. Casaregola
*Attorney, Agent, or Firm*—Ralf H. Siegemund

[57] ABSTRACT

A carriage for suspending a load such as a compartment of a vehicle or the like, is basically comprised of a pin, rod or bar from which the load is centrally suspended and which by and in itself is suspended by two wheel carriers, each supporting a wheel for running on opposite flanges of a rail; each wheel carrier has a clamping bore intersecting the bore receiving the load carrying rod and a tension pin-with-wedge is inserted in an intersecting bore for clampingly engaging the load bearing rod upon tightening of a nut on an external thread of the respective tension pin; loosening of the nuts releases a contour fitting engagement and permits the wheel carrier to be adjusted into any desired position on the load carrying rod; the wedges may be constructed as cutting edges for cutting into the load carrying rod upon tightening.

14 Claims, 6 Drawing Figures

III
III
15
12
10
11
13
1
6
17
16

1
10
14a
6

10
1
6
14b 10
1
6
14c

15'
21
17
16

CARRIAGE

BACKGROUND OF THE INVENTION

The present invention relates to the construction of a carrier which includes a traverse pin or rod for mounting wheel carriers at variable spacing in order to adjust the gage of the running wheels which run on the lower flange of a rail track.

Carriage constructions of the type to which the invention pertains are, for example, disclosed in German printed patent application No. 30 42 225. In order to adjust the wheel spacing to the requisite gage, pins are provided which traverse bores of a traverse rod on which the wheel carriers are mounted. These bores are spaced apart on the rod at particular distances corresponding to possible and conceivable gage and gage width adjustment. However, it was found that these bore spacings are often too large for purposes of optimizing the wheel adjusting to a particular gage, particularly in those cases in which a standardized carriage is to be usable in conjunction with differently wide and broad rail flanges. In order to permit a higher grade or finer adjustment of the gage, the above mentioned patent application proposes the providing of a thread on the traverse rod. However, it was found that on one hand certain portions of the traverse experience very high loads so that on the other hand in view of the notch stress rather unduly large traverse cross sections are needed which means that material is to some extent wasted while of course necessary in order to accommodate the aforementioned problem. Moreover, it was found that the cutting of a thread into the traverse under consideration of a corresponding construction of the wheel carriers constitutes an unduly high cost.

DESCRIPTION OF THE INVENTION

It is an object of the invention to provide a new and improved carriage construction permitting stepless adjustment of the gage position of the wheels and its carriers with relatively little expenditure.

It is a particular object of the present invention to provide a new and improved carriage which includes a frame part or the like in which is mounted a pin or rod which in turn supports wheel carriers to be adjusted axially with respect to the rod, i.e. as far as mutual spacing is concerned, in order to adapt the carriage to different rail gages. The rod carries the load such as a vehicle and is suspended by the wheel carriers.

In accordance with the preferred embodiment of the present invention, it is suggested to provide particular bores in the wheel carriers such that they partially intersect at right angles and over a circular segment, the bore in the wheel carriers being traversed by the traverse rod. This supplemental bore in such a wheel carrier receives a tension pin having a thread onto which is threaded a clamping nut bearing against an outside wall or surface of the respective wheel carrier; moreover, the tension wedge has a wedge shape groove which becomes deeper in one particular axial direction such that upon tightening of the clamping nut the wedge shaped indentation is forced against or even into the traverse rod in the range of the aforementioned circular segment. This way an areal pressure is provided which suffices in many instances for securing the wheel carrier on the traverse pin or rod in the desired disposition. The adjustment of the wheel carrier in that fashion is independent from any particular location on the traverse rod so that in fact the wheel carrier can be steplessly adjusted on that rod. Moreover, the adjustment is particularly independent from the frequently quite large width tolerances of the rail flanges onto which the wheel are supposed to run. Therefore, the distance between a flange of the rail and the rim flange of a wheel, or of any lateral guiding rolls in the case of an overhung trolley kind of arrangement, can readily be adjusted simply through axial shifting of one or the other or both of the wheel carriers on the traverse rod and retightening the respective tension wedges.

The main instrument in the adjustment on one hand and positioning and securing on the other hand is the rather simple wedge shaped groove or indentation in the tension wedge. In cases, the feature may be too simple in order to provide adequate security and locking of the wheel carrier position. In this case, the edge of the wedge shaped identation may in fact be constructed as wedge-shaped cutting edges. Upon tightening the tension pin by means of the tension nut as described, the wedge edges cut, in effect, into the traverse pin. The wedge-shaped cutting may, in fact, be established through the limit of a flat portion of the indent or even by a concave indent or by an obtuse angular cavity. The wedge shaped indentation may have a self locking wedge inclination of preferably five percent (5%). The height of the circular segment in which the wedge-shaped indentation is situated above the traverse rod should be approximately five percent (5%) of the diameter of the bore in which the traverse and axial pin is inserted.

The aforementioned wedge cutters are preferably harder than the material of the traverse rod and, therefore, work themselves into the coating of the traverse rod upon tightening of the tension wedge in the aforementioned manner. This way, one produces a form fitting relationship or nearly so which permits the taking up of high axial forces. This forceful forming or contour fitting procedures, of course, indents in the traverse rod which, however, are not expected to interfer with any subsequent adjustment to a different gage. Should these indentations happen to interfer with a minute gage adjustment, then this seeming difficiency can be avoided simply by turning the traverse rod to some extent so that this previously produced indent in the traverse pin is angularly offset from the new position of the wheel carrier.

The aforementioned force fitting, frictional or even cutting connection experiences an axial load which load may exceed frictional adhesion. Therefore, the traverse rod will tend to move axially in the wheel carrier bore. It may be advisable here to provide an additional locking feature preventing such a shift. In accordance with a further feature of the invention, it is suggested to arrange the two tension pins in two facing wheel carriers so as to provide oppositely oriented directions of clamping. The same effect can be obtained if the tension pins are oriented in the same direction with their threads having opposite pitch. In either case, the tension pins will tend to turn about that particular cutting edge operating in a direction opposite to the direction of loading so that as a consequence further tightening of the nut causes deeper penetration of this particular cutting edge into the traverse rod. Consequently a more intimate contour adaptation is obtained which in turn results in an increase in clamping, inherently avoiding axial displacement.

For further increase of clamping, it is suggested to provide the clamping bore in a compression range or zone of the wheel carrier which is set up by the traverse rod tending to exert a bending moment upon the wheel carrier due to the suspension load on the rod. This bending moment provides a pressure force that acts upon the cutting wedge and causes the same to cut deeper into the surface zone of the traverse pin. Therefore, it can be seen that the mutual interaction of the various components enhances the clamping action, and the firmness in the disposition and mounting of the wheel carriers on the traverse pin is ensured.

In furtherance of the invention, it is suggested to provide the clamping bore referred to above as a blind bore which, in effect, saves operating and working costs. In fact, therefore, they can be provided in those locations in which penetrating bores could not be provided otherwise. The clamping nut referred to repeatedly above may abut the wheel carrier under conditions preventing loosening which surface should have a contour that includes teeth, ribs or the like, which work themselves into the surface of the wheel carrier upon tightening of the nut so that again, a quasi-form closed connection is provided for which will not loosen even if for some reason or another the tension wedge settles in a manner that would otherwise tend to loosen the connection. Settling of the tension wedge may be compensated for through the arrangement of one or more disk springs interposed between the tensioning nut and the part against which the nut is to act.

The traverse bolt or rod is preferably passed through and inserted in a bore of a load carrying facility in the general sense. A wedge prevents axial displacement of the bollt or rod. Such a connection, however, should still permit turning of the traverse rod within the wheel carriers under consideration that the load carrying facilities act and are provided for in a tranverse direction as far as load transfer is concerned.

DESCRIPTION OF THE DRAWINGS

FIG. 2 is a section view taken along the lines II—II in FIG. 1;

FIG. 3*a* is a section view taken along the line III—III indicated in FIG. 2;

FIGS. 3*b* and 3*c* illustrate variance in the formation in the cutting wedge, the respective elements being shown on an enlarged scale, any of them being amenable to utilization in the embodiment shown in FIGS. 1, 2 and 3*a;* and FIG. 4 illustrates a section similar to the section shown in FIG. 2 but illustrating a variance as far as construction details are concerned.

Proceeding now to the detailed description of the drawings, FIG. 1 illustrates in section a rail 4 with flanges 5 being provided for overhung trolley and suspension type vehicles. The two flanges 5 are provided for engagement with and as running surfaces for the wheels of a carriage. The Figures furthermore show two wheels 3 and 3' having a rim or flange 9 and 9' respectively; the wheels 3 and 3' run on the flanges 5. Wheel 3 is journalled in a wheel carrier 1 whereas wheel 3' is journalled in a wheel carrier 2. The wheel 3' is connected through a transmission 20 to a drive motor or engine or the like being part of the carriage or mounted to the carriage. The motor is not illustrated. Wheel 3, on the other hand, idles as far as it is journalled in wheel carrier 1 is concerned.

Figure 1:
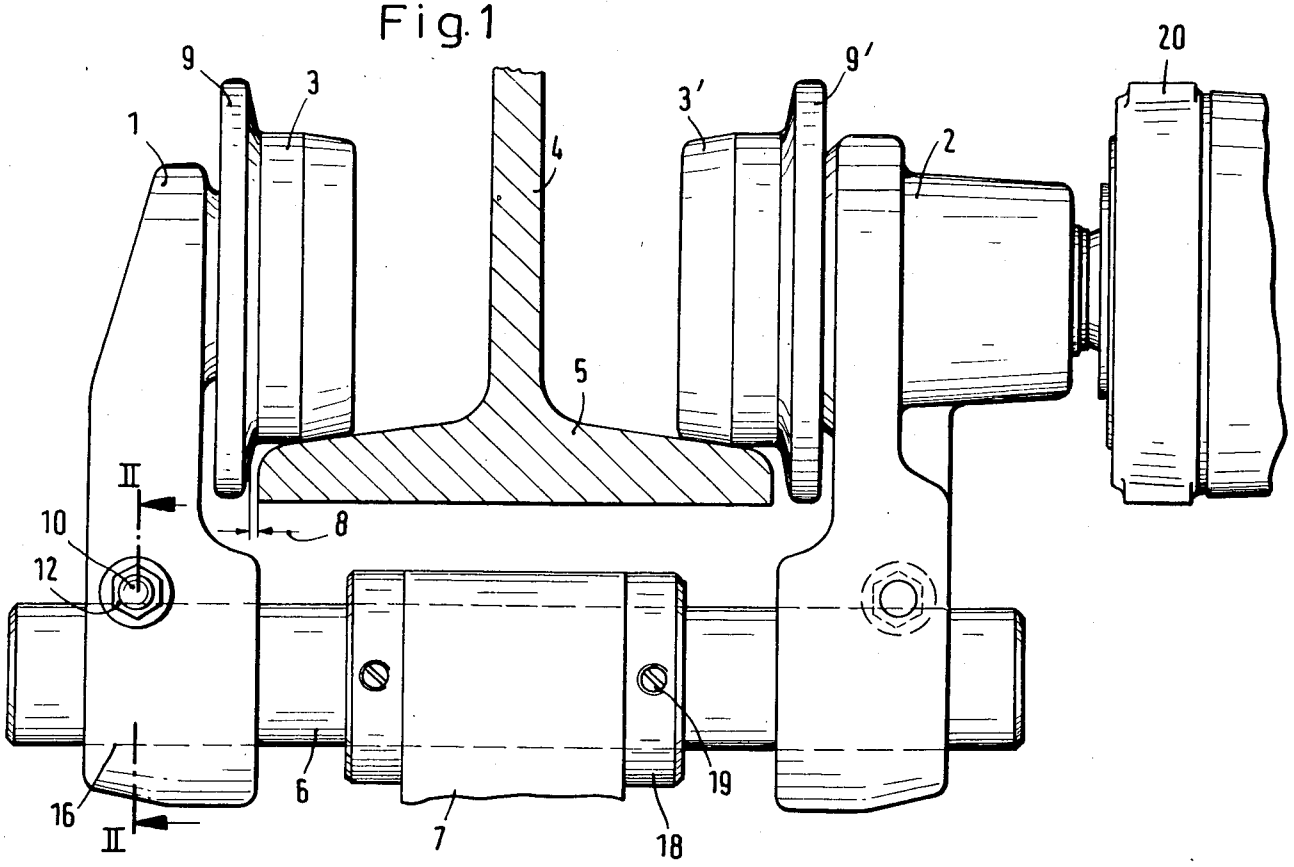
FIG. 1 is a front view partially shown in section of a carriage in accordance with the preferred embodiment of the present invention for practising the best mode thereof.

Reference numeral 8 refers to the distance to be maintained between the rim or flange element 9 of the wheel 3 and the rail flange 5. There is analogously a distance to be maintained between the flange 9' and the flange portion 5 on which the wheel 3' runs. In view of the fact that the flange 5 has particular lateral or width dimensions it can readily be seen that the observance of a particular distance 8 and of an analogous distance on the other side is determined by the spacing of the wheels 3 and 3' from each other. This in turn is determined by the spacing between the carriers 1 and 2.

The spacing between the wheel carriers 1 and 2 is determined by their disposition on the traverse pin, rod or bolt 6. The load bearing rod 6, moreover, is provided as a suspension element from which, generally speaking, a load is suspended by means of the load suspension structure 7. In essence, structure 7 is a suspension device for the vehicle which runs on the rail 5 by means of the suspending carriage as illustrated. The vehicle suspension and load receiving structure 7 is particularly mounted to the traverse rod 6 and that position is fixed by means of wedges, on adjusting rings 18 and bolts 19.

The vehicle as suspended is assumed now to run on the rail flanges 5 in such a manner that the axis of symmetry or, better, the plane of symmetry that runs through the rail 4 coincides with the axis of symmetry as far as the load is concerned by the load suspension device 7. It can be assumed that for practical purposes this particular plane should run through the center of gravity of the structure which is being suspended as a whole. The wheel carriers 1 and 2 therefore have to be affixed to the traverse rod 6 in such a manner that these conditions of symmetry can be observed. However, it will readily be apparent that any other condition can be provided for. It is essential that the wheel carriers 1 and 2 are mounted on the traverse 6 in such a manner that in fact that plane of symmetry between and running through the rail 4 is the plane of symmetry of disposition of the two wheel carriers 1 and 2, and the suspension of any load from the traverse 6 can be selected in order to accommodate load and moment conditions provided by the load in order to observe symmetrical load conditions throughout.

In the following, reference will be made to details concerning the mounting of the wheel carriers 1 and 2 on the traverse rod 6. Each of these wheel carriers 1 and 2 is provided with a clamping bore 15 such as is shown in the FIG. 3 as well as in FIG. 4. On the other hand, each of the wheel carriers 1 and 2 has, of course, a cylindrical bore 16 through which passes the traverse rod 6. The bores 15 are now provided to intersect the respective bore 16. This range of intersection establishes a circular section 17. In other words, section 17 is the largest linear dimension delineating the area and zone through which the bore 15 cuts across the bore 16. The circular section 17 can also be defined by that portion of the bore 16 which is cutaway in a plane which runs through the axis of bore 15 and extends at right angles to the axis of bore 16. The dotted line indicates the circle of the intersection; it is spaced from the circle at about 5% of the diameter of bore 16.

Figures 2, 3A, 3B, 3C, 4:
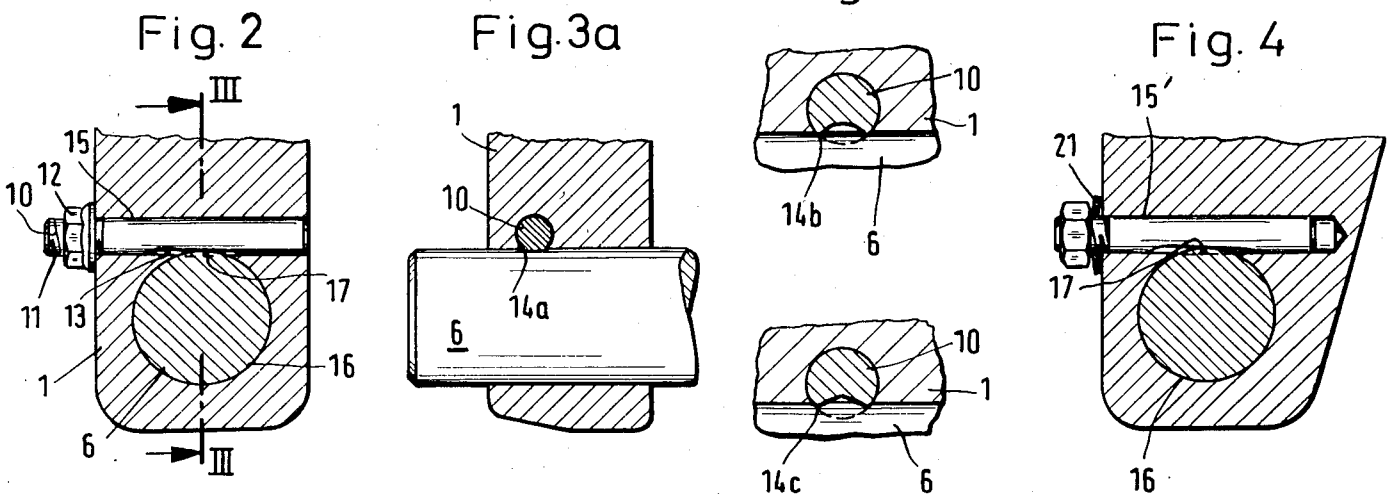

The tension wedge element 10 is provided with a wedge shaped or flattening indentation 13 which extends into the bore 16 if element 10 has the disposition as shown, for example, in FIG. 2. The angle of inclination of indentation relative to the axis of pin 10 amounts to about 5%. Prior to insertion of the rod 6 through the various elements, wedge element 10 is inserted deeper into the bore 15 and particularly it is inserted into a disposition so that the largest (deepest) zone of the indentation 13 faces the interior of bore 16. This, then, permits insertion of the rod 6 without impediment. Now, the respective carrier be it 1 or 2, is shifted on the rod 6 so as to obtain the desired position on one hand with regard to the suspension structure 7 so that, on the other hand, a particular spacing 8 will be obtained. The mounting procedure may be carried out while the wheels runs on the flange 5 in which case the flange 5 is available directly for adjustment purposes, i.e. the wheel 3 or 3' is shifted to obtain the desired spacing 8, the shifting being carried out by shifting the respective wheel carrier on the traverse pin 6.

After the proper adjustment has been obtained, the nut 12 is threaded on and is tightened which, in effect, amounts to a retraction and attempted pull out of the tension element 10 which in the drawing of FIG. 2 has a tendency to shift the pin element 10 to the left as the nut 12 abuts, in this case, the carrier 1. As a consequence the cutting edge 14*a* of the wedge surface 13 or the sharpened edges 14*b* as per FIG. 3*b* or edges 14*c* as per FIG. 3*c*, will be forced into the rod 6.

FIG. 3*a* illustrates by way of example that the cutting edge may be simply a flattening but a concave groove or obtuse angular groove with appropriate cutting edge as per FIG. 3*b* and FIG. 3*c* respectively, is actually preferred; the choice here depends to a considerable extent upon the material used for the tension wedge 10 on one hand and for the rod 6 on the other hand. If the mechanical strength and hardness properties of the materials are similar, a sharper cutting edge is needed if the rod material is softer as compared with a tension pin material a less sharp and blunter edge configuration can be chosen.

Another aspect is the following: upon tightening the two nuts, a torque is exerted upon the respective pin. As the pin has worked its edges into the rod 6, that torque tends to shift the rod 6 axially. However, if the thread pitches are opposite, then the two torques are oppositely (axially) oriented on the rod 6 and balance is maintained. Alternatively, (as actually shown in FIG. 1) the nuts act on opposite sides so that again any shifting torque from the two carriers 1, 2 acts on rod 2 in opposite directions. It should be noted further, that the bores 15 are arranged in compression zones of the respective wheel carriers (1,2), such zones being set up by the bending moment exerted by the rod 6 upon the carriers. The force originates, of course, in the load as suspended at 7.

The bore 15 as shown in FIG. 2 penetrates the wheel carrier element 1 in its entirety. FIG. 4 is a modification which in fact differs from FIGS. 2–3 only by the fact that the bore 15' receiving the tension pin 10 is a blind bore. This section provides the advantage that moisture cannot penetrate through the open end of the bore. Also, FIG. 4 illustrates that the nut has a widened annular surface established through slightly protruding ribs which causes the nut to act in a self locking manner. Moreover, the embodiment of FIG. 4 shows that a disk spring 21 is interposed between the nut 12 and the wheel carrier in this case. This feature of course, can also be used in the embodiment as per FIG. 2.

The invention is not limited to the embodiments described above but all changes and modifications thereof, not constituting departures from the spirit and scope of the invention are intended to be included.

We claim:

1. A suspending carriage having wheels for running on oppositely extending flanges of a rail, comprising:

a traverse rod provided for suspending a load such as a vehicle carriage or the like;

a pair of wheel carriers, each carrying a wheel respectively for running on the flanges of the rail, each of the wheel carriers having a cylindrical bore being traversed by and receiving said rod for suspending said rod;

a clamping bore in each of said wheel carriers extending at right angles to the respective rod receiving bore and intersecting the same over a circular arched portion;

a pair of pin like tension wedge elements having threaded portions respectively received by said clamping bores, each having a wedge shaped indentation for being clamped against the traverse rod; and a pair of nuts respectively threaded on the threaded portions of said tension elements as projecting from the respective wheel carrier, for being tightened against the respective wheel carrier whereby the wedge-shaped indentation of the respective tension element is forced against the traverse rod as it traverses the respective bore in the respective wheel carrier.

2. A device as in claim 1 wherein said tension elements have cutting edges bounding the respective wedge shaped indentations.

3. A device as in claim 2 wherein said cutting edges are established through a planar flat portion.

4. A device as in claim 2 wherein said cutting edges are established through a concave configuration of said wedge shaped indentation.

5. A device as in claim 2 wherein said cutting edges are established through obtuse-angle shaped configuration of said indentation.

6. A device as in claim 1 wherein said wedge shaped indentation has inclination on the order of five percent (5%).

7. A device as in claim 1 wherein the radial dimension of said circular arc corresponds to about five percent (5%) of the diameter of the respective rod receiving bore.

8. A device as in claim 1 wherein directions of tensioning of the tension wedges for the two wheel carriers act in opposite direction of tension.

9. A device as in claim 1 wherein the threading on the tension wedges have opposite pitch.

10. A device as in claim 1 wherein the respective bores for receiving the respective pinlike tension elements are arranged in that portion of the wheel carrier which is subject to compression under the suspending load.

11. A device as in claim 1 wherein said clamping bore is a blind bore.

12. A device as in claim 1 wherein the nut is provided with means for preventing loosening.

13. A device as in claim 12 including disk spring means interposed between the nut and the respective wheel carrier.

14. A device as in claim 1 wherein said load is suspended centrally between said two wheel carriers, there being means for locking the load in position.

* * * * *